United States Patent [19]

Wyatt

[11] 4,374,785

[45] Feb. 22, 1983

[54] METERING DEVICE FOR FUEL CONTROL SYSTEM

[75] Inventor: Charles E. Wyatt, Kennedyville, Md.

[73] Assignee: Miletech, Inc., Greenville, Del.

[21] Appl. No.: 226,865

[22] Filed: Jan. 21, 1981

[51] Int. Cl.[3] ..... F02M 7/06

[52] U.S. Cl. ..... 261/51; 137/599; 251/117; 261/68

[58] Field of Search ..... 251/117; 137/599; 261/51, 68

[56] References Cited

U.S. PATENT DOCUMENTS

| | | | |
|---|---|---|---|
| 645,560 | 3/1900 | Fox | 137/599 |
| 1,883,240 | 10/1932 | Phelan | 251/117 |
| 2,085,628 | 6/1937 | Brannan | 137/599 |
| 2,095,560 | 10/1937 | Vickers | 137/599 |
| 2,370,021 | 2/1945 | Downey | 251/117 |
| 2,497,664 | 2/1950 | Gray et al. | 137/599 |
| 2,518,212 | 8/1950 | Wilson | 137/599 |
| 3,186,307 | 6/1965 | Ellenbogen | 137/599 |
| 3,289,694 | 12/1966 | Frye | 251/117 |
| 3,327,760 | 6/1967 | Crawford, Jr. | 137/599 |
| 3,343,820 | 9/1967 | Elliott | 261/51 |
| 3,409,277 | 11/1968 | Reise | 261/51 |
| 3,537,434 | 11/1970 | Herpin | 261/18 A |
| 4,186,707 | 2/1980 | Driggers | 261/69 R |

*Primary Examiner*—Tim R. Miles

*Attorney, Agent, or Firm*—Connolly and Hutz

[57] ABSTRACT

A metering device for a fuel control system includes a block having a pair of parallel transverse bores which are interconnected to a pair of parallel longitudinal bores so as to provide a plurality of passageways in which appropriate valves may be placed.

5 Claims, 6 Drawing Figures

METERING DEVICE FOR FUEL CONTROL SYSTEM

BACKGROUND OF INVENTION

U.S. patent application Ser. No. 197,695 filed Oct. 16, 1980, now abandoned, discloses a fuel control system for dramatically increasing the fuel efficiency of motor vehicles. That system includes a meter valve for supplying gas to the carburetor under ordinary operating conditions and also includes a by-pass valve for supplying gas under unusual conditions such as during acceleration of the vehicle. The present invention relates to a method and arrangement for incorporating both of such valves in a common mounting block which may be conveniently adapted to the system.

SUMMARY OF INVENTION

An object of this invention is to provide a mounting block which is adapted for incorporating both a meter valve and a by-pass valve so as to be readily adaptable to the aforenoted fuel system.

A further object of this invention is to provide a method of manufacturing such a device in a convenient and economical manner.

In accordance with this invention, a pair of parallel passageways are formed from one face of a solid block and terminate within the block. A pair of longitudinal passageways are then formed in the block from one face thereof and intersect the transverse passageways to provide flow communication therebetween. One of the longitudinal passageways extends completely through the block and is located at the remote end of the transverse passageways. The other longitudinal passageway is then partially plugged so as to leave a branch passageway to simply interconnect both transverse passageways. Suitable valves may then be inserted in the various passageways for adaptation to the aforenoted fuel control system.

THE DRAWINGS

DETAILED DESCRIPTION

Figure 1:
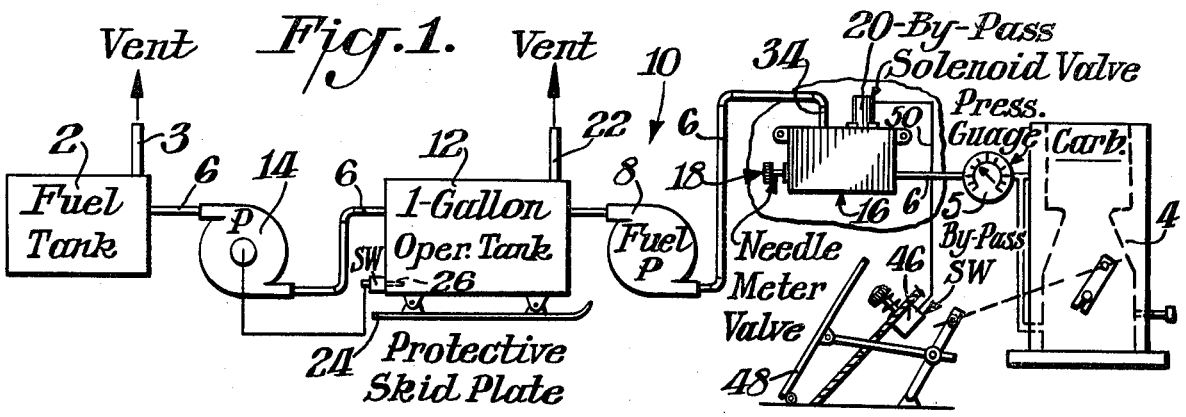
FIG. 1 is a schematic side view of a fuel control system of the type disclosed in U.S. application Ser. No. 197,695 filed Oct. 16, 1980 and which incorporates the metering device of this invention.

FIG. 1 illustrates a fuel control system 10 of the type disclosed in U.S. patent application Ser. No. 197,695 filed Oct. 16, 1980, the details of which are incorporated herein by reference thereto. System 10 includes a fuel storage tank 2 having a vent 3 with storage tank 2 feeding gasoline by means of pump 14 through fuel line 6. In accordance with that system, operating tank 12 is mounted to the fuel line 6 downstream from main tank 2 and is provided with its pump 8 to withdraw gasoline therefrom. Operating tank 12 includes a vent line 22 and a level sensing switch 26 for actuating pump 14 to assure that gasoline will be supplied from tank 2 when the level of gasoline in tank 12 is at a predetermined minimum. A protective skid plate 24 is also provided for operating tank 12. The system 10 also includes a metering device 16 which includes a main meter valve 18 and a by-pass valve 20 as later described. Fuel is fed from fuel line 6 into metering valve 16 through inlet line 34 and is then discharged from metering valve 16 through the portion of fuel line 6 downstream therefrom where it is fed into carburetor 4. Under ordinary operating conditions, the fuel is supplied to carburetor 4 through main meter valve 18. Under certain conditions, however, such as during acceleration when it is necessary to increase the supply of fuel, the fuel is additionally supplied through by-pass valve 20. The actuation of by-pass valve 20 (which is preferably a solenoid valve) may be accomplished by locating a suitable actuating by-pass switch 46 in the path of downward motion of gas pedal 48.

FIG. 1 illustrates a further safeguard to system 10 wherein a pressure gauge 5 is mounted to fuel line 6 downstream from metering device 16 and upstream from carburetor 4 so as to provide a ready check that the proper amount of fuel pressure is maintained during feed of gasoline from the fuel pump 8 to the carburetor 4. The fuel feed pressure is easily adjusted by turning meter valve 18 in or out until the desired pressure is indicated on gauge 5.

Figure 3:
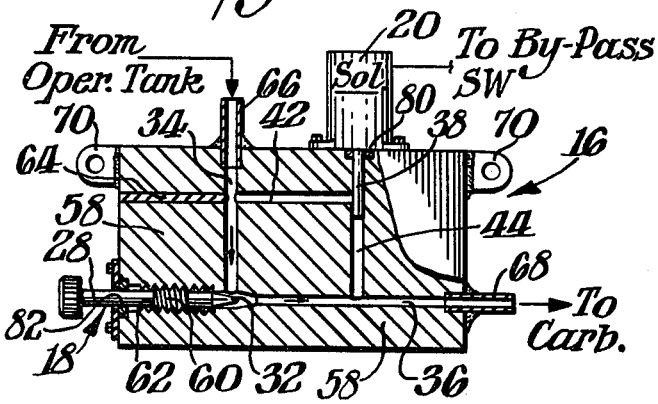
FIG. 3 is a cross-sectional view in elevation taken through FIG. 2 along the line 3—3.

In general, operation of metering device 16 might best be understood by reference to FIG. 3. As indicated therein, an inlet line is provided by means of first transverse passageway 34 which may be connected to fuel line 6 by nipple 66. Under ordinary driving conditions, the fuel flows through inlet line 34 and then through longitudinal passageway or outlet line 36 past main or meter valve 18 which is conveniently in the form of a needle valve 28 having a threaded portion 60 engaging complementary internal threads 62 to control the positioning of the pointed end 32 at the junction of passageways 34 and 36. The fuel could then exit into the downstream portion of fuel line 6 by means of nipple 68.

Under acceleration conditions, it is necessary to supply a greater amount of fuel to carburetor 4. This is accomplished by actuating by-pass valve 20. As illustrated in FIG. 3, by-pass valve 20 is in the form of a solenoid valve which includes a rod 38 extending into transverse passageway or by-pass branch 44. By-pass branch 44 in turn communicates with inlet line 34 by means of transverse by-pass branch 42. When solenoid rod 38 is extended, communication between inlet line 34 and by-pass branch 44 is prevented. Conversely, when rod 38 is retracted, the fuel may flow through by-pass branch 44 and exit from outlet line 36.

As a safety factor, the solenoid valve 20 is normally spring biassed closed. Only during automobile operation is the valve electrically activated to close by-pass passage 44.

Figure 4:
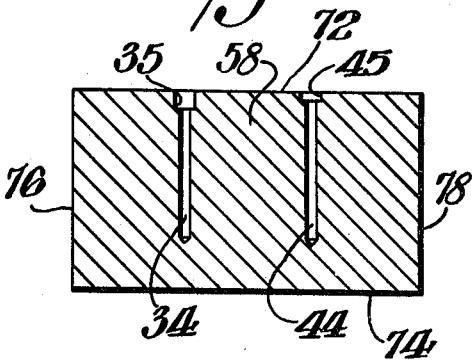
FIGS. 4–6 are cross-sectional views in elevation showing the sequence of steps for forming the device shown in FIGS. 2–3.
Figure 5:
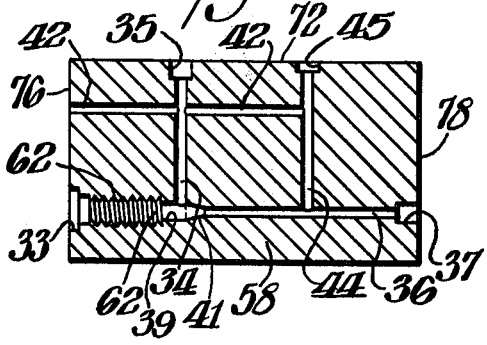
Figure 6:
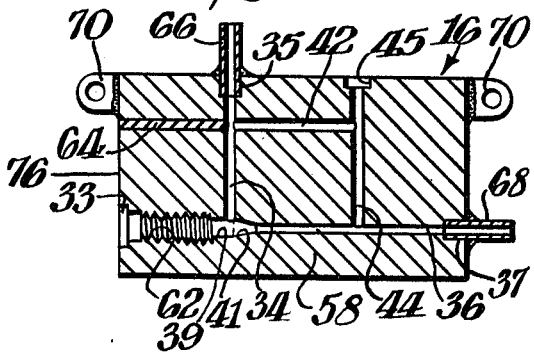

As illustrated in FIG. 3, the various valves are mounted to block 58, and their passageways are formed therein. FIGS. 4–6 illustrate the steps of forming the passageways in block 58 and mounting valves 18 and 20 thereto.

As shown in FIG. 4, a pair of bores are formed transversely in mounting block 58 so as to form inlet line 34 and by-pass branch 44. These bores extend from the outer face 72 of block 58 and terminate short of outer face 74. A pair of counterbores 35, 45 are then made at face 72 as a separate step or simultaneous with bores 34 and 44.

FIG. 5 shows the next sequence of steps wherein a longitudinal bore 42 is formed from outer face 76 of block 58 until the bore intersects passageway 44. In so forming the longitudinal bore 42, the longitudinal bore also intersects transverse passageway 34. A second longitudinal passageway 36 is then formed by a core extending completely through block 58 from outer face 76 to outer face 78. Bore 36 is located so as to intersect the closed ends of bores 34, 44. In addition, counterbores 33 and 39 are made from face 76 wherein counterbore 39 extends through bore 34. During the termination of counterbore 39, a valve seat 41 is formed to correspond to valve tip 32 of valve 28. A portion of counterbore 39 is then tapped 62 to receive threaded portion 60 of needle valve 28 as shown in FIG. 3. Counterbore 37 is formed in bore 36 at face 78.

FIG. 6 illustrates further steps in the manufacture of metering device 16. As indicated therein, the portion of bore 46 between face 76 and bore 34 is suitably plugged by plug 64 so that the only portion of bore 42 which is unplugged is that portion corresponding to the branch which connects bores or passageways 34 and 44. Nipples 66 and 68 are then secured in counterbores 35 and 37 by any suitable means such as welding. As shown in FIG. 3, solenoid valve 20 would then be mounted with respect to passageway 44 with the end of passageway 44 sealed by any suitable sealing means such as O-ring 80 located in counterbore 45. Similarly needle valve 28 would be mounted in longitudinal bore 36 and sealing could be effected by O-ring 82 located in counterbore 33. Any suitable mounting means such as the plates and fasteners illustrated in FIG. 3 could be utilized for mounting a by-pass valve 20 and main valve 18.

Figure 2:
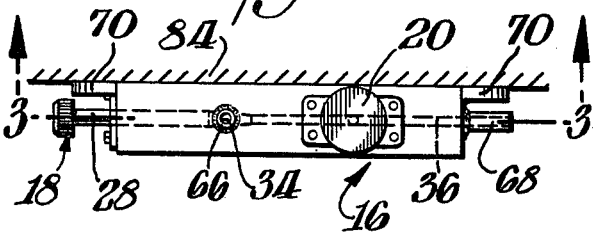
FIG. 2 is a top plan view of the metering device shown in FIG. 1.

After the various passageways have been formed in block 58 and preferably but not necessarily before the valves have been mounted thereto, a pair of mounting brackets 70 are secured by any suitable means such as welding to block 58. Mounting brackets 70 would later be utilized for mounting block 58 within the vehicle such as to the inside fender wall or fire wall 84 (FIG. 2).

As should be appreciated, the concepts of this invention thus readily lend themselves for forming a metering device which is particularly adapted for use in the aforenoted fuel control system. The invention permits the metering device to be formed in a compact manner at relatively low cost and is done in such a manner that the unit could be easily attached into the fuel line and mounted to a vehicle.

Metering device 16 may be used in a fuel control system similar to FIG. 1 but wherein tank 12 and pump 8 are omitted although the efficiency of the system may not be as great.

Although the metering device of this invention has been described with particularity to the aforenoted fuel control system, the teachings of this invention may be applied to any system which utilizes a pair of selectively operating valves to control the flow of suitable fluids whether in liquid and/or gaseous form. Similarly although the various passageways are shown as pairs of parallel bores, the invention may be practiced with the passageways located in any suitable manner including angular or curved passageways all or some of which are formed from the same face of the mounting block so as to result in the interconnected inlet passageway, outlet passageway, by-pass passageway and by-pass branch with the respective valve suitably connected thereto.

What is claimed is:

1. A metering device, in combination therewith, a fuel control system for use in a vehicle having a fuel line for supplying fuel to a carburetor, said metering device comprising a mounting block, a first pair of passageways extending into said block and exposed at one face of said block, said passageways terminating in closed ends within said block, a second pair of passageways extending into said block and intersecting said first pair of passageways, a main meter valve in one of said second pair of passageways with one of said pair of passageways being exposed from said block to comprise an outlet passageway, one of said first pair of passageways comprising an inlet passageway and the other of said first pair of passageways comprising a by-pass passageway, the other of said second pair of passageways comprising a by-pass branch interconnecting said inlet passageway and said by-pass passageway, a by-pass valve in said by-pass passageway for selectively closing flow communication between said inlet passageway and said by-pass passageway, an upstream portion of said fuel line being connected in flow communication with said inlet passageway, and a downstream portion of said fuelline connected in flow communication with said outlet passageway.

2. The device of claim 1 wherein said first pair of passageways are parallel transverse bores, and said second pair of passageways being parallel longitudinal bores.

3. The device of claim 2 including mounting brackets mounted to said block.

4. The device of claim 3 wherein said main valve is a needle valve, and said by-pass valve being a solenoid valve.

5. The device of claim 4 including a first nipple connected to said block communicating with said inlet passageway, and a second nipple connected to said block communicating with said outlet passageway.

* * * * *